US009072959B2

(12) United States Patent
Bernal Bascuñana

(10) Patent No.: US 9,072,959 B2
(45) Date of Patent: Jul. 7, 2015

(54) ATTACHMENT FOR SLIDING BOARDS

(71) Applicant: Juan Miguel Bernal Bascuñana, Valencia (ES)

(72) Inventor: Juan Miguel Bernal Bascuñana, Valencia (ES)

( * ) Notice: Subject to any disclaimer, the term of this patent is extended or adjusted under 35 U.S.C. 154(b) by 0 days.

(21) Appl. No.: 14/398,173

(22) PCT Filed: May 22, 2013

(86) PCT No.: PCT/ES2013/070323
§ 371 (c)(1),
(2) Date: Oct. 31, 2014

(87) PCT Pub. No.: WO2013/175042
PCT Pub. Date: Nov. 28, 2013

(65) Prior Publication Data

US 2015/0130147 A1 May 14, 2015

(30) Foreign Application Priority Data

May 24, 2012 (ES) ..... 201230562 U

(51) Int. Cl.
*A63C 10/10* (2012.01)

(52) U.S. Cl.
CPC ..... *A63C 10/10* (2013.01)

(58) Field of Classification Search
CPC ..... A63C 10/18; A63C 10/10; A63C 10/14; A63C 10/04; A63C 10/20
USPC ..... 280/14.22, 14.24
See application file for complete search history.

(56) References Cited

U.S. PATENT DOCUMENTS

| | | | | | |
|---|---|---|---|---|---|
| 3,936,063 | A | | 2/1976 | Sittmann | |
| 5,284,066 | A | * | 2/1994 | Weiss | 74/594.6 |
| 5,354,088 | A | * | 10/1994 | Vetter et al. | 280/618 |
| 5,520,405 | A | * | 5/1996 | Bourke | 280/613 |
| 5,667,237 | A | * | 9/1997 | Lauer | 280/607 |
| 5,690,351 | A | * | 11/1997 | Karol | 280/618 |
| 5,713,594 | A | * | 2/1998 | Jenni | 280/624 |
| 5,791,678 | A | * | 8/1998 | Perlman | 280/618 |
| 5,826,910 | A | * | 10/1998 | Ricks et al. | 280/618 |
| 5,906,388 | A | * | 5/1999 | Neiley | 280/613 |
| 5,984,325 | A | * | 11/1999 | Acuna | 280/14.24 |

(Continued)

FOREIGN PATENT DOCUMENTS

| | | | |
|---|---|---|---|
| ES | 2188403 | A1 | 6/2003 |
| ES | 2261095 | A1 | 11/2006 |

(Continued)

*Primary Examiner* — Brodie Follman
(74) *Attorney, Agent, or Firm* — Richard M. Goldberg

(57) ABSTRACT

A binding for a sliding board includes a stationary part connected to the board, forming a rotating body, and provided with a retaining and fastening arrangement; and a moving part provided with an attachment and retaining arrangement for attaching and retaining same in relation to the retaining and fastening arrangement of the stationary part. The retaining and fastening arrangement of the stationary part are formed by peripherally arranged flanges separated from the board, as well as including portions with no flanges. The moving part includes a boot securing arrangement including a cavity, which can also rotate, provided with internal ridges, the cavity having a diameter approximately equal to that of the rotating body of the stationary part together with the flanges, such that the connection between the stationary part and the moving part takes the form of a bayonet coupling obtained by insertion and rotation.

15 Claims, 9 Drawing Sheets

(56) References Cited

U.S. PATENT DOCUMENTS

| | | | | |
|---|---|---|---|---|
| 6,022,041 | A * | 2/2000 | Dailey et al. | 280/618 |
| 6,102,430 | A * | 8/2000 | Reynolds | 280/618 |
| 6,283,491 | B1 * | 9/2001 | Bush et al. | 280/611 |
| 6,575,489 | B1 * | 6/2003 | White | 280/613 |
| 7,210,698 | B2 * | 5/2007 | Dandurand | 280/614 |
| 7,270,337 | B1 * | 9/2007 | Carotenuto | 280/14.24 |
| 7,837,219 | B1 * | 11/2010 | Cordes | 280/618 |
| 8,128,117 | B2 * | 3/2012 | Neiley et al. | 280/618 |
| 2003/0184031 | A1 * | 10/2003 | Feurer et al. | 280/14.24 |
| 2004/0148808 | A1 * | 8/2004 | Okajima | 36/117.3 |
| 2004/0188983 | A1 * | 9/2004 | Scholten | 280/618 |
| 2005/0006876 | A1 * | 1/2005 | Dodge | 280/625 |
| 2005/0051978 | A1 * | 3/2005 | Sabol | 280/14.24 |
| 2006/0087090 | A1 * | 4/2006 | Reynolds | 280/14.24 |
| 2006/0091622 | A1 * | 5/2006 | Sabol | 280/14.24 |
| 2007/0290463 | A1 * | 12/2007 | White | 280/14.24 |
| 2009/0194956 | A1 * | 8/2009 | Holzer | 280/14.24 |
| 2009/0273163 | A1 * | 11/2009 | Sorenson | 280/613 |
| 2010/0109289 | A1 * | 5/2010 | Wischhusen et al. | 280/613 |
| 2010/0171277 | A1 * | 7/2010 | Hwongbo | 280/14.24 |
| 2011/0254239 | A1 * | 10/2011 | Jung | 280/14.24 |
| 2012/0211968 | A1 * | 8/2012 | Saunders | 280/623 |

FOREIGN PATENT DOCUMENTS

| | | | |
|---|---|---|---|
| ES | 2357338 | T3 | 4/2009 |
| ES | 2330600 | A1 | 12/2009 |
| ES | 2341825 | A1 | 6/2010 |
| WO | 96/23557 | A1 | 8/1996 |

* cited by examiner

Fig. 10
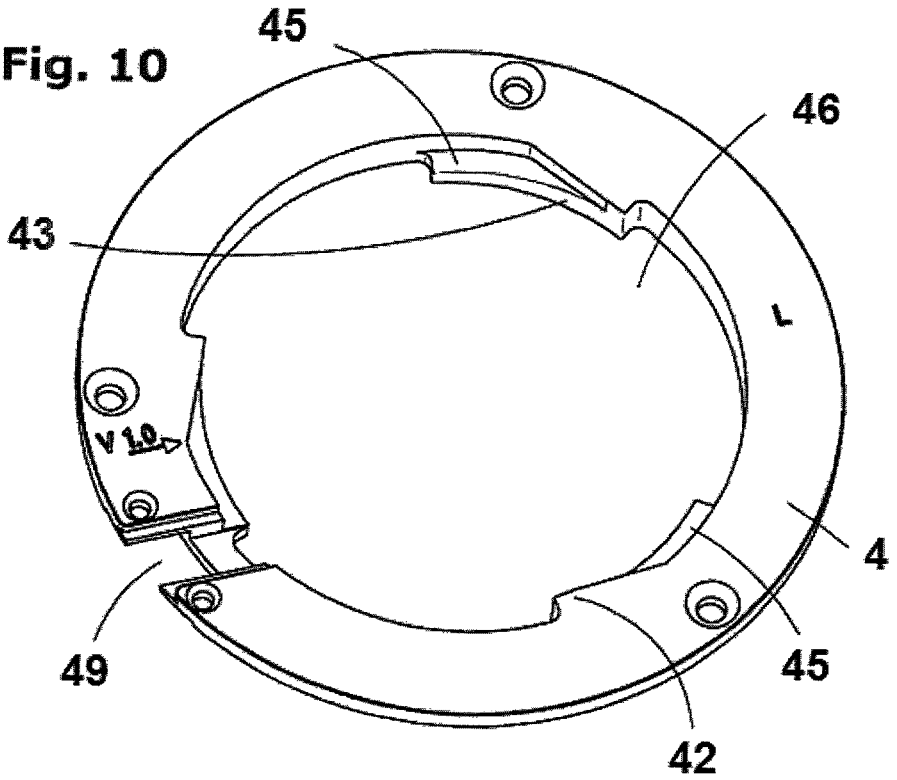
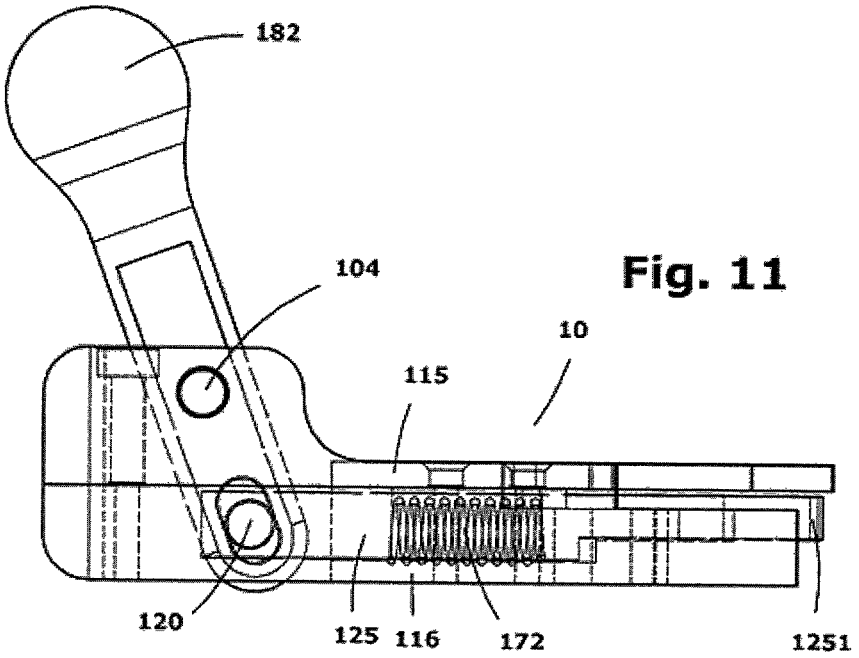
Fig. 11

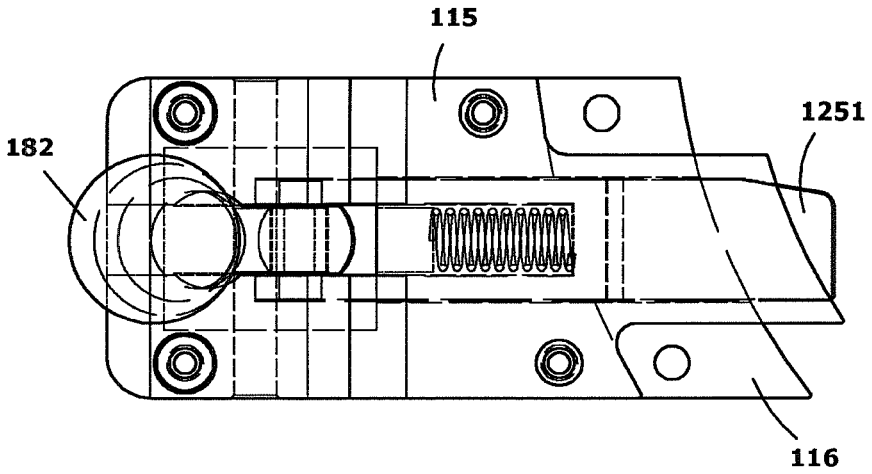
Fig. 12
Fig. 13
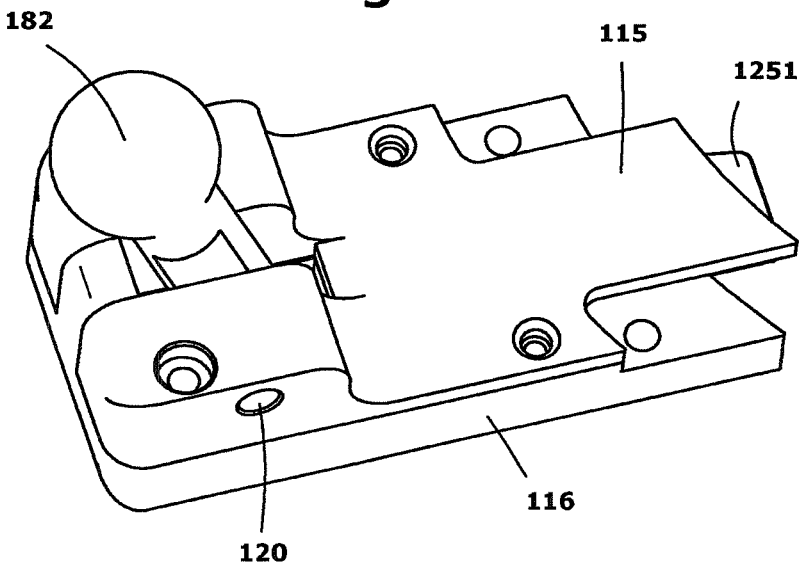

ATTACHMENT FOR SLIDING BOARDS

BACKGROUND OF THE INVENTION

This invention consists of a binding for a sliding board, for example for sliding on snow or the boards known as "snowboards", which allow an easy and quick release of the anchoring mechanism located in the boot through a rotation and bayonet clamping mechanism.

The sport of snowboarding or sliding through the snow on board, requires that both feet of the user are placed immobile on the board, so that the user can perform the required maneuvers while being able to maintain the balance on the board.

The immobile placement is performed in many different ways. A common way is to have a body embracing the boot as a sandal so that the athlete must sit down in order to place each boot on the corresponding binding; one example is shown in ES 2 357 338.

ES 2 261 095 describes a release system for ski boots and snowboard bindings, comprising an electronic device with an emitter and a receiver electronic device which performs the opening of the binding. This requires that both the board and the emitter, possibly holding the handle of a ski pole, comprises an energy source, which increases the weight and complexity of the binding.

ES 2 341 825 describes a magnetic binding device of a boot to a ski board or snowboard. This binding may be unstable when usual skiing or snowboarding impacts occur, for example in jumps, being difficult its separation.

WO 96/23557 describes an adjustable binding device in angular position.

ES 2 188 403 describes a binding for snowboards comprising plates with protuberances susceptible of binding to several components installed in the boots' base with binding elements by longitudinal displacement.

ES 2 330 600 describes an autonomous pneumatic control system securing boots to snowboards or skis by vacuum suction, which requires that the athlete carries a suction pump.

SUMMARY OF THE INVENTION

As pointed out previously, this invention is a bond system of a boot to a sliding board by means of an assembly of binding elements (herein referred to as "binding"); snowboard comprises a plurality of perforations on which there is a fixed part with retaining and locking means; consisting of a revolution body, usually a solid disc with many longitudinally elongated holes, allowing longitudinal adjustments of the position of such disc on the holes and; according to the particular embodiment, several holes run along the board allowing different base sites of the disc. Over the mentioned disc there is a second disc also comprising a set of elongated holes forming circumference arches, with which an angular positional adjustment of the disc is possible. The invention also comprises outer projections separated from the board, and arranged at regular or irregular intervals along the disc periphery. The second disc, once placed over the first one, is fixed to the board by screws running through the corresponding holes of the said discs and those of the board, which are properly positioned before finally being tightened. It is expected that one of the discs includes a projection and the other one a recess in accordance for an appropriate assembly.

For the fastening of the boot to the board, a support has been designed, which may be susceptible to the binding of the boot or be part thereof, comprising a circular disc according to the second hole. Such gap comprises inner projections of no longer than the distance between the outer projections of the second disc; such inner projections will be located in a lower position, so that when the circular gap of the support is introduced on the second disc, the projections are displayed downwardly.

At least the second disc or the circular hole is provided with an elastic retaining mean, so that when the insertion and corresponding rotation, bayonet-type, occurs, the binding will be firm, until manual action takes place on such elastic mean by means of, for example, a button or a lever laterally located. Thus a quick and easy binding is achieved, and a quick release if required, allowing a very comfortable and versatile use.

BRIEF DESCRIPTION OF THE DRAWINGS

To illustrate the following explanation, we enclose herein, three sheets of drawings in which the essence of the invention is represented in three figures in which:

FIG. 10 shows a lateral view of the external binding arc, usually joined to the boot support.

FIG. 11 shows a lateral transparent view of the clamping bolt of the binding elements.

FIG. 12 shows an upper transparent view of the clamping bolt of FIG. 11.

FIG. 13 shows a perspective view of the clamping bolt before its mounting in the binding device.

DESCRIPTION OF PREFERRED EMBODIMENT

Figure 1:
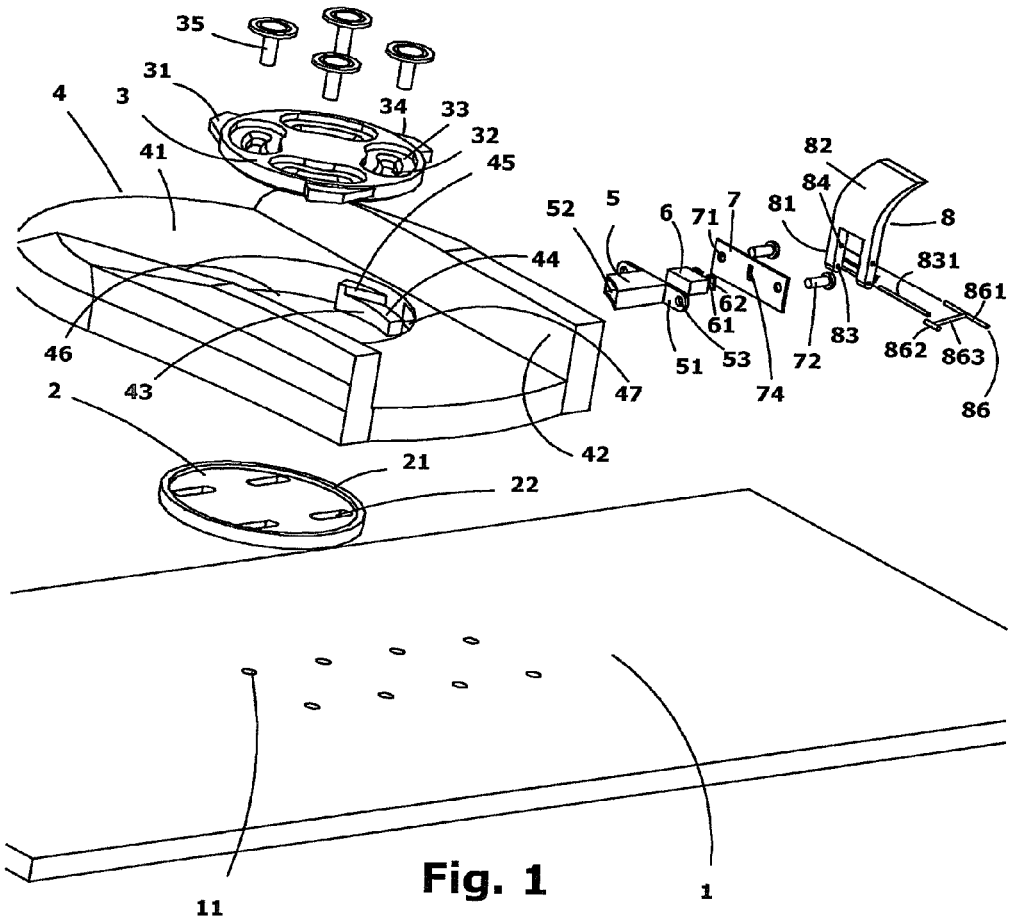
FIG. 1 shows an explosion view of the assembly of elements forming the binding device of the invention.
Figure 2:
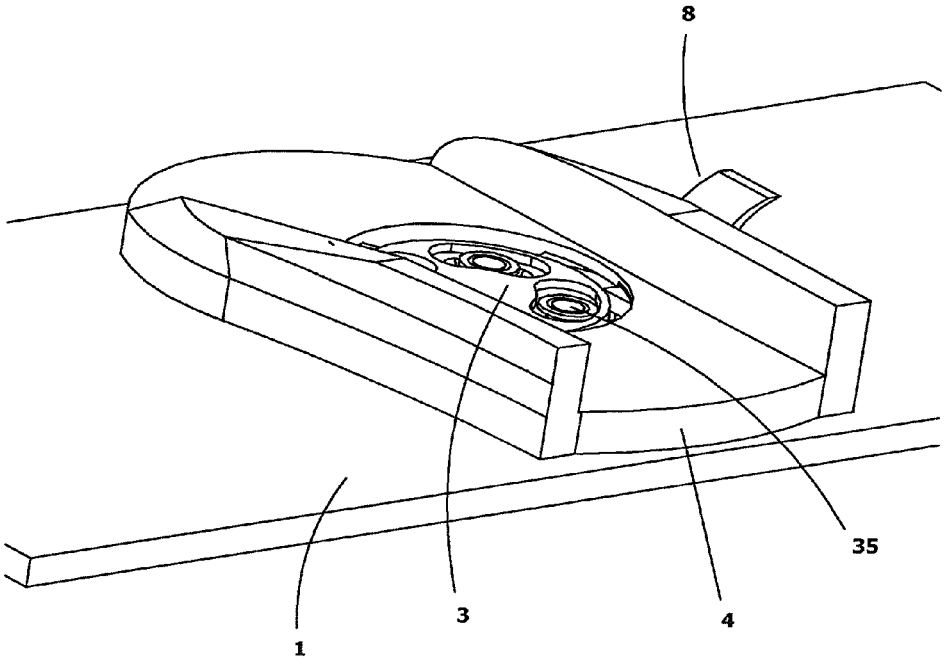
FIG. 2 shows a perspective view of the binding device of FIG. 1 mounted on the board.
Figure 3:
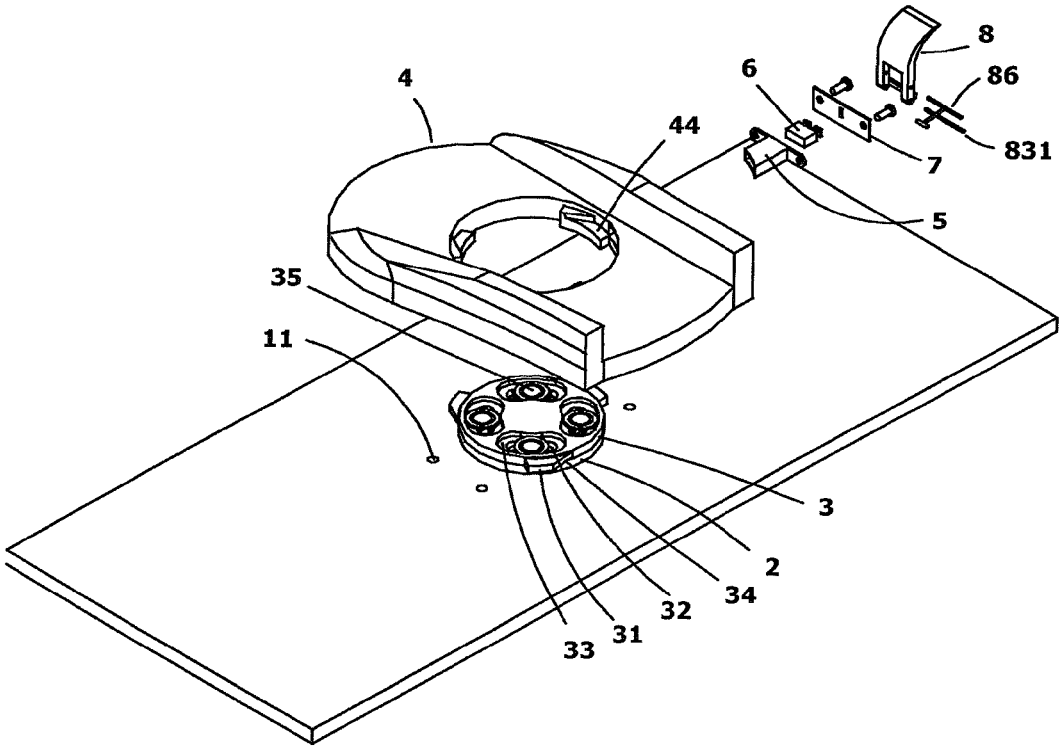
FIG. 3 shows a view of the binding of FIGS. 1 and 2, in which a first assembly of elements is mounted on the board.
Figure 4:
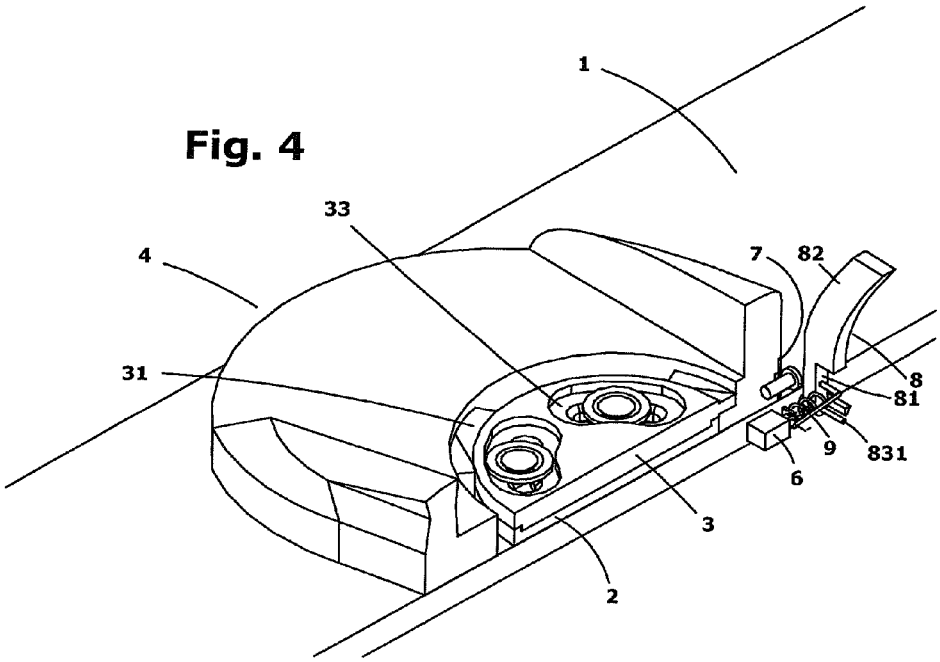
FIG. 4 shows a view of a section of the board with the mounted binding.
Figure 5:
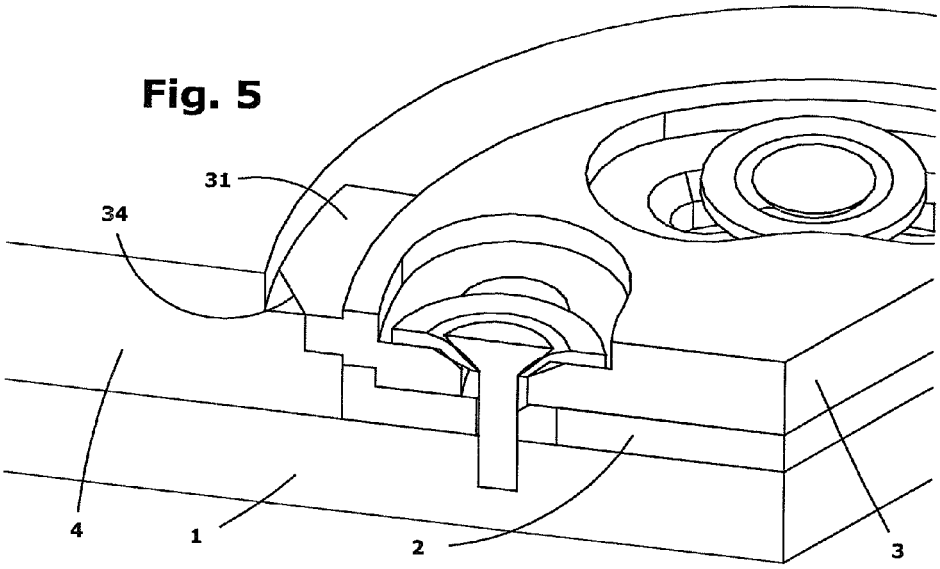
FIG. 5 shows a view of an angled section on the section of FIG. 4.
Figure 6:
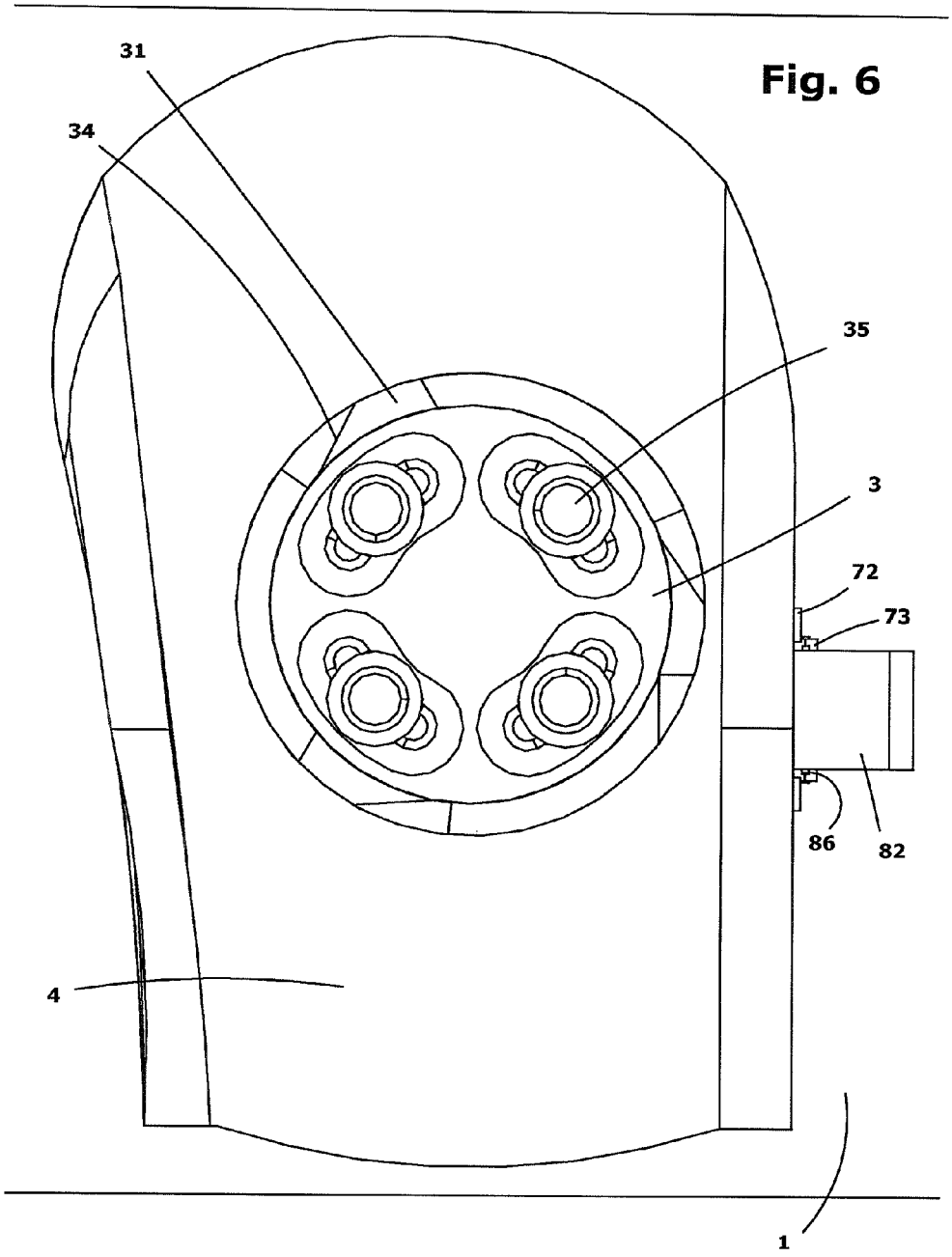
FIG. 6 shows a plan view of the binding mounted on the table.
Figure 7:
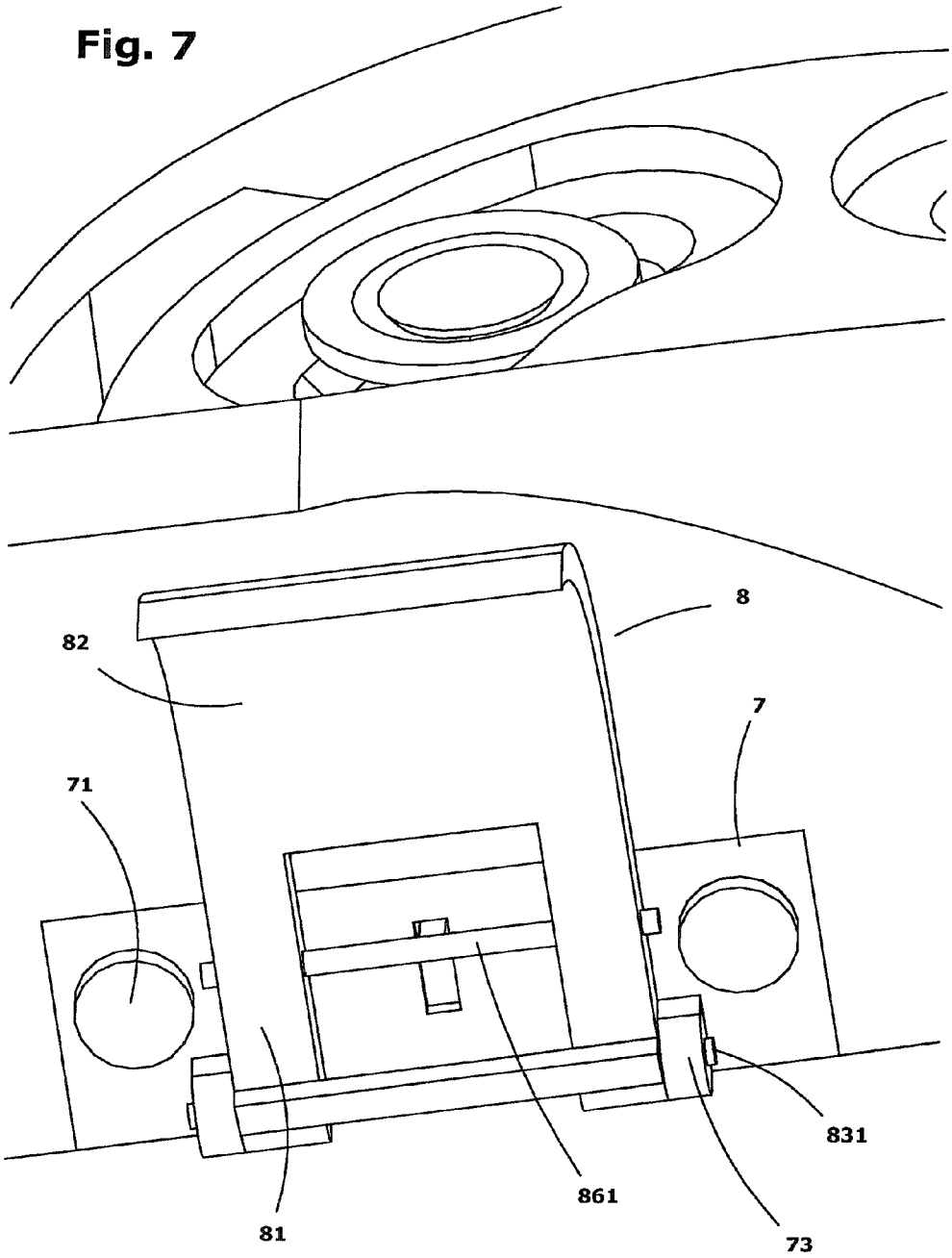
FIG. 7 shows a perspective view of a detail of a release component of the binding.
Figure 8:
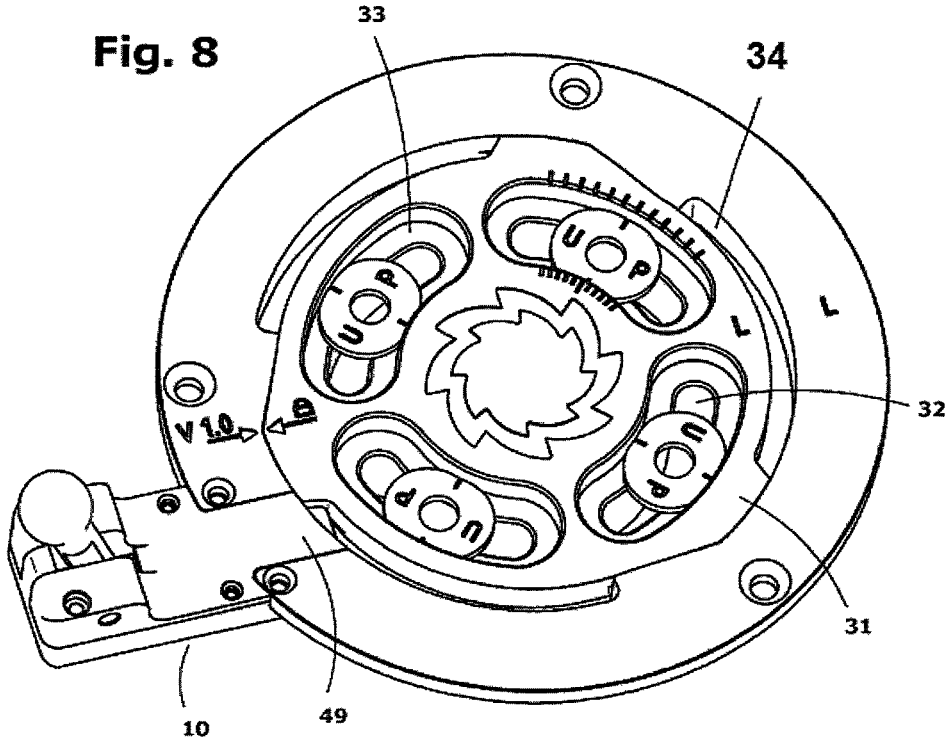
FIG. 8 shows a perspective view of a mounted binding device according with a compact embodiment.
Figure 9:
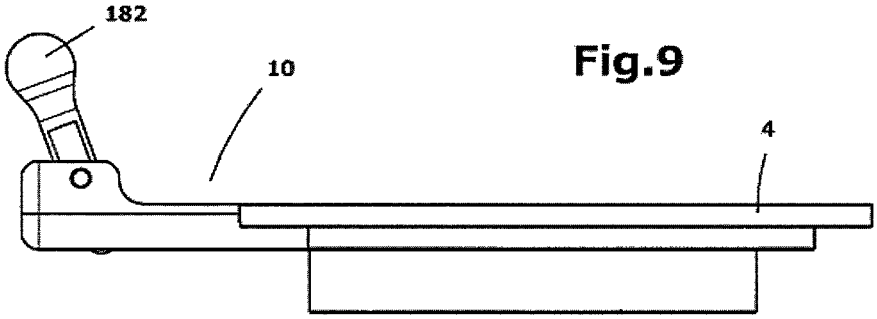
FIG. 9 shows a lateral view of the binding device of FIG. 8.

As noted above, this invention consists in a binding for sliding boards, particularly designed for snowboards (1). The board has sets of holes (11) arranged linearly, which allow the binding of the invention to be arranged in different positions along the board (1). Over these holes (11) in each of the sets, there is a first disc (2) with holes linearly grooved (22). Thus, the said first disc (2) can be placed in at least three different positions (according to the representation of FIG. 1), on the holes of one end, on the holes of the other end or on the set of the central holes; according to the needs, there will be more or less number of holes (11) in the board (1). For an acute adjustment, grooved holes (22) are arranged so that, once the corresponding screws (35) are mounted, the disc can still move to either side until it is fully satisfactory for the user. Preferably, the first disc (2) comprises a peripheral ledge (21).

On top of the first disc (2) there is a second disc (3). This disc has a set of grooved holes (32) in the form of an arc of circumference, which are topped at the top by a recess (33) of the same general form, but with greater width than the grooved holes (32). These grooved holes (32) are pierced by the screws (35) with the head clamped in the recess (33).

Given the form of arc, it is possible to provide the second disc (3) with the desired rotation position for an adequate comfort of the user, which will subsequently determine the corresponding anchoring position.

Once the first (2) and the second discs (3) are placed in the correct position, proceed to tighten the screws and leave the fixed part of the binding in a permanent position of the board.

The second disc (3) includes side flanges (31) on the outer contour of the disc, which, at least in one side, is topped by a beveled portion (34), and also includes other portions of the said contour without flanges.

The binding further comprises a mobile part (4) which is attached or by any suitable means to the user's boot. Such mobile portion (4) comprises a support surface (41) and side walls (42). For example, straps for holding the boot may be installed in these side walls. The mobile part (4) comprises a hollow area (46) with an inner diameter which is substantially equal to the outer diameter of the second disc comprising the side flanges (31).

In some portions of the hollow area (46), there are inner projections (43) comprising an upper surface (44) and a beveled stopper (45). The mobile part (4) is placed on the second disc (3) with a certain rotation angle, so that the inner projections (43) pierce the portions without flanges of such second disc (3). By rotating the mobile portion in the right direction, the projections (43) can remain below the side flanges (31), until the beveled stopper reaches the corresponding beveled portion of the second disc (3), in locking position of the fixed and mobile parts.

The retainer in a locking position takes place by a latch (6) acting against the action of at least one spring (9). The latch (6) runs through an inner hole (52) formed in one component (5), in turn arranged in a hole (47) transversely practiced in the wall of the hollow area (46); such piece (5) comprises outer binding flanges (51) with perforations (53) for the passage of screws (72).

The latch (6) consists of an essentially prismatic component, with projections (62) on its outer face which in turn comprise cross-holes (61). In the holes (61) of such projections (62), a first transverse shaft of one component in double "T" (86). The latch (6), the component (5) and the springs (9) are externally supported by a shield (7) provided with holes (71) through which it is fastened by screws (72). The shield comprises a central window (74) allowing the passage of beam (863) connecting transverse shafts (861, 862) of the component in double "T" (86). Respect to the said component in double "T" (86), the first transverse shaft (862), normally shorter than the second transverse shaft (863) is fastened to the holes (61) of the projections (62) and pushed by springs (9) towards the inside of the hollow region (46) of the mobile part (4), the crossbar (863) runs through the window (74) of the shield (7) and the second transverse shaft (861), normally longer than the first one, is secured in the holes (84) of an outer lever (8). The outer lever (8) comprises a pulsation area (82) and a driving area (81), possibly provided with a trim. The driving area comprises holes (84) in which the second transverse shaft (861) is fixed to the component in double "T" (86). Moreover, the lever (8) also comprises second holes (83) in which a shaft (831) is placed, which in turn is fastened on supportive supports (73) to the shield (7) and externally arranged, provided with the corresponding holes for a secure binding of such shaft (831).

Thus, in a rest position, the latch (6) partially emerges in the hollow area (46) of the mobile part (4) so when such latch (6) is in the use position to prevent the reverse rotation for the extraction of the mobile part relative to the fixed part, for it prevents displacement with respect to the side flanges (31) forcing its introduction placing the mobile part (4) on the fixed part during rotation the latch (6) is pushed by the beveled portion (34) of the flanges (31), forcing its introduction in the inner hole (52) of the component (5), which will slide along such flange until the end, when the latch will return to the rest position.

To release, simply retract the latch (6) by oppression the pulsation area (82) of the lever (8), so that the component in double "T" (86) will be stretched and so will the latch (6), thereby allowing rotation of the mobile part (4) and its removal in the correct position.

In a simplified embodiment, the discs (2, 3) are only one piece, forming a solid assembly and reducing the manufacturing costs.

According with an optimized embodiment, a locking bar or locking latch (10) is used for the binding. Said locking latch (10) is formed by two parts, an upper part (115) and a lower part (116), between which is defined a gap (125) through which a latch (1251) slides; the upper part (115) supports a shaft (104) supporting a first specie lever, with a push actuator (182) at one end and a countersink hole with a drive shaft (120) of the latch (1251), with a return spring (172) installed inside the hole. At least one part of the locking latch (10) is inserted in a location cutout (49) formed in the disc that forms the mobile part (4) in such a way that can be easily mounted independently of the other elements.

In summary, a bayonet-type lock with a retaining device when in use position, and releasing means of the retention mean in the locking and releasing phases of the binding.

The invention claimed is:

1. Binding for a sliding board, comprising:

a fixed part attached to the board, which forms a revolution body, provided with a retention and locking system including flanges arranged peripherally and spaced from the board and portions without flanges; and a mobile part provided with a fastening and retention system for engagement with the retention and locking system of the fixed part, the mobile part including a fastening system for a boot, and a substantially circular hollow area provided with inner projections, the hollow area having a diameter approximately equal to the revolution body of the fixed part with the flanges so that a clamping union between the fixed part and the mobile part is adapted to be performed by a bayonet insertion and rotation, the mobile part further comprising a gap formed transversely in a wall defining the hollow area;

a push pin extending through the gap for retaining the mobile part in a locking position relative to the fixed part; and a spring acting against the push pin.

2. Binding for a sliding board according to claim 1, wherein the board comprises fastening holes linearly arranged thereon for securing the fixed part at different positions along the board.

3. Binding for a sliding board according to claim 1, wherein the fixed part includes a first disk of separation which is nearest to the board and a second disc carrying said flanges, and wherein the first disc comprises a peripheral ledge and a set of linearly grooved holes within the peripheral ledge by which the first disc is adapted to be secured to the board.

4. Binding for a sliding board according to claim 3, wherein the second disc includes a number of grooved arcuate holes;

wherein each said grooved arcuate hole is provided within a recess of the same general shape but having a greater width than the respective grooved hole.

5. Binding for a sliding board according to claim 3, wherein the flanges are arranged on an outer contour of the second disc.

6. Binding for a sliding board according to claim 1, wherein upper portions of said flanges include beveled portions.

7. Binding for a sliding board according to claim 1, wherein the mobile part includes an attachment surface and side walls which include fastening straps for the boot.

8. Binding for a sliding board according to claim 1, wherein some portions of the hollow area include inner projections which have a top surface and a beveled stopper for engaging with the flanges.

9. Binding for a sliding board according to claim 1, further including a retaining part having an inside latch, with the retaining part adapted to be inserted inside the gap;

wherein the retaining part also includes comprises outer fastening flanges with openings for the passage of screws; and wherein the latch includes an essentially prismatic component, with projections on an outer face thereof which in turn comprise diagonal holes.

10. Binding for a sliding board according to claim 9, further comprising an outer lever that activates the latch, said outer lever comprising a pulsation portion and an operating portion, the operating portion comprising first holes and second holes.

11. Binding for a sliding board according to claim 9, further comprising a shield which externally attaches the latch, the retaining part, and springs to the mobile part, the shield having holes through which the shield is adapted to be fastened by screws to the mobile part, and the shield including a central window which allows passage of a crossbar connecting first and second transverse shafts of a double "T" component.

12. Binding for a sliding board according to claim 11, further comprising an outer lever that activates the latch, said outer lever comprising a pulsation portion and an operating portion, the operating portion comprising first holes and second holes;

wherein the first transverse shaft of the double "T" component is shorter than the second transverse shaft, and is attached in the diagonal holes of the projections and pushed by springs towards an inside of the hollow area of the mobile part, wherein the crossbar is adapted to move through the window of the shield, and wherein the second transverse shaft is fastened in the first holes of the outer lever.

13. Binding for a sliding board according to claim 12, further comprising a shaft secured in the second holes and is in turn fastened in holes formed in supports holding the shield and externally displayed.

14. Binding for a sliding board according to claim 1, further comprising a locking latch, and wherein the mobile part includes a location cutout for receiving the locking latch.

15. Binding for a sliding board according to claim 14, wherein the locking latch includes an upper part and a lower part, with a gap defined between the upper and lower parts, and through which the locking latch is adapted to slide;

wherein the upper part supports a shaft supporting a first specie lever, with a push actuator at one end and a countersink hole with a drive shaft of the latch at an opposite end, with a return spring installed inside the gap.

* * * * *